United States Patent [19]

Born

[11] Patent Number: 4,618,068

[45] Date of Patent: Oct. 21, 1986

[54] METHOD AND APPARATUS FOR SHIPPING AND STORING CARGO

[76] Inventor: Raymond W. Born, 4211 W. First St., Space 121, Santa Ana, Calif. 92703

[21] Appl. No.: 777,012

[22] Filed: Sep. 17, 1985

[51] Int. Cl.[4] ..... B65D 7/24

[52] U.S. Cl. ..... 220/4 R; 220/1.5; 220/4 F

[58] Field of Search ..... 220/1.5, 4 R, 4 F, 76, 220/75

[56] References Cited

U.S. PATENT DOCUMENTS

| | | | |
|---|---|---|---|
| 4,452,366 | 6/1984 | Nagai et al. | 220/4 R |
| 4,506,798 | 3/1985 | Goutille | 220/1.5 |
| 4,576,300 | 3/1986 | Kedzior | 220/4 F |

*Primary Examiner*—George T. Hall

*Attorney, Agent, or Firm*—Sellers and Brace

[57] ABSTRACT

Disclosed is a method and apparatus for shipping and safeguarding cargo utilizing a conventional bulk cargo container in combination with one or more unique knock down containers constructed for efficient and convenient stowage therewithin. The smaller containers permit cargo consigned to different destinations to be segregated and safeguarded throughout transit and to be shipped and handled as a unit over all common portions of the shipping route. Additionally the smaller containers can be handled individually by simple mobile or light capacity equipment and can also serve as indoor or outdoor weather tight, tamper-proof storage in areas controlled by individual users. Other features of the smaller containers include stackability and built-in provision lengthwise of the upper and lower lateral corners of channels receptive of lifting devices and useful in loading and unloading these containers relative to a larger container, or the like. These lifting channels accommodate specially constructed dollies, grappling hooks or other load lifting devices.

45 Claims, 17 Drawing Figures

FIG. 1
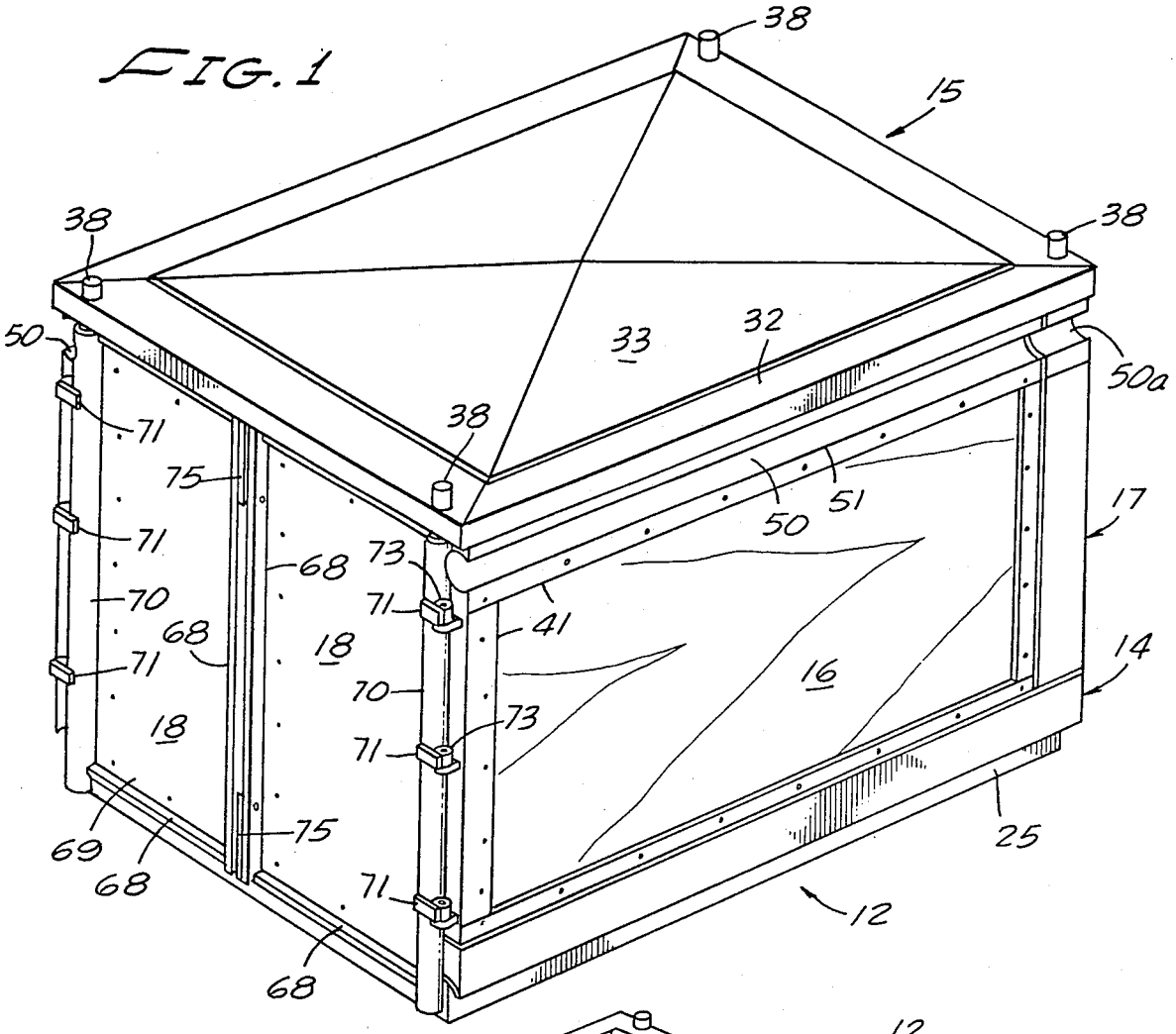
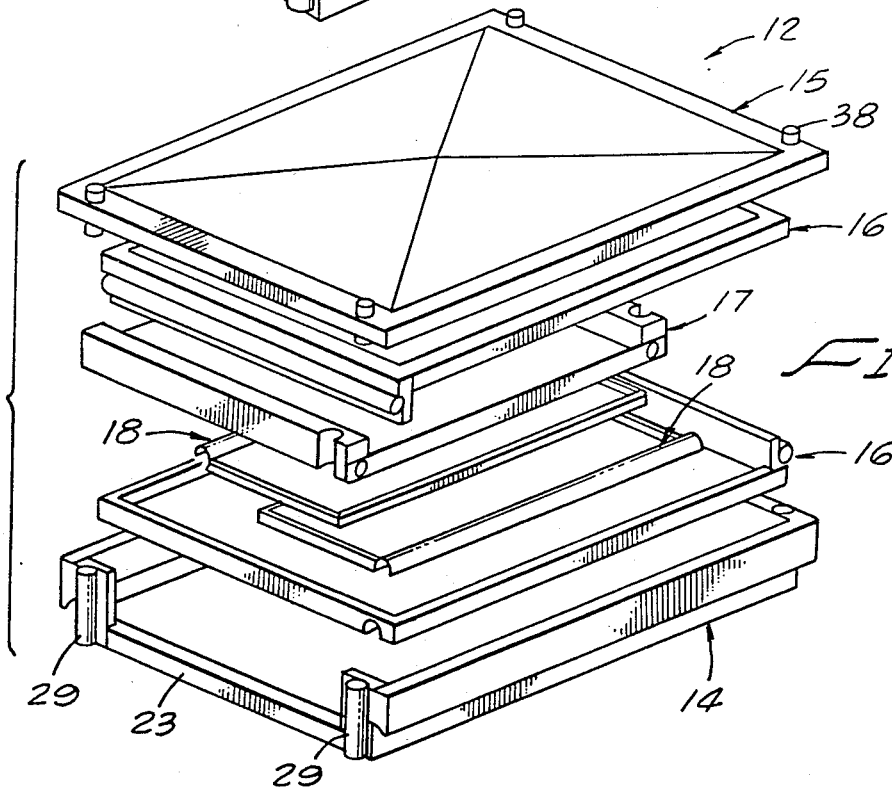
FIG. 2

FIG. 3
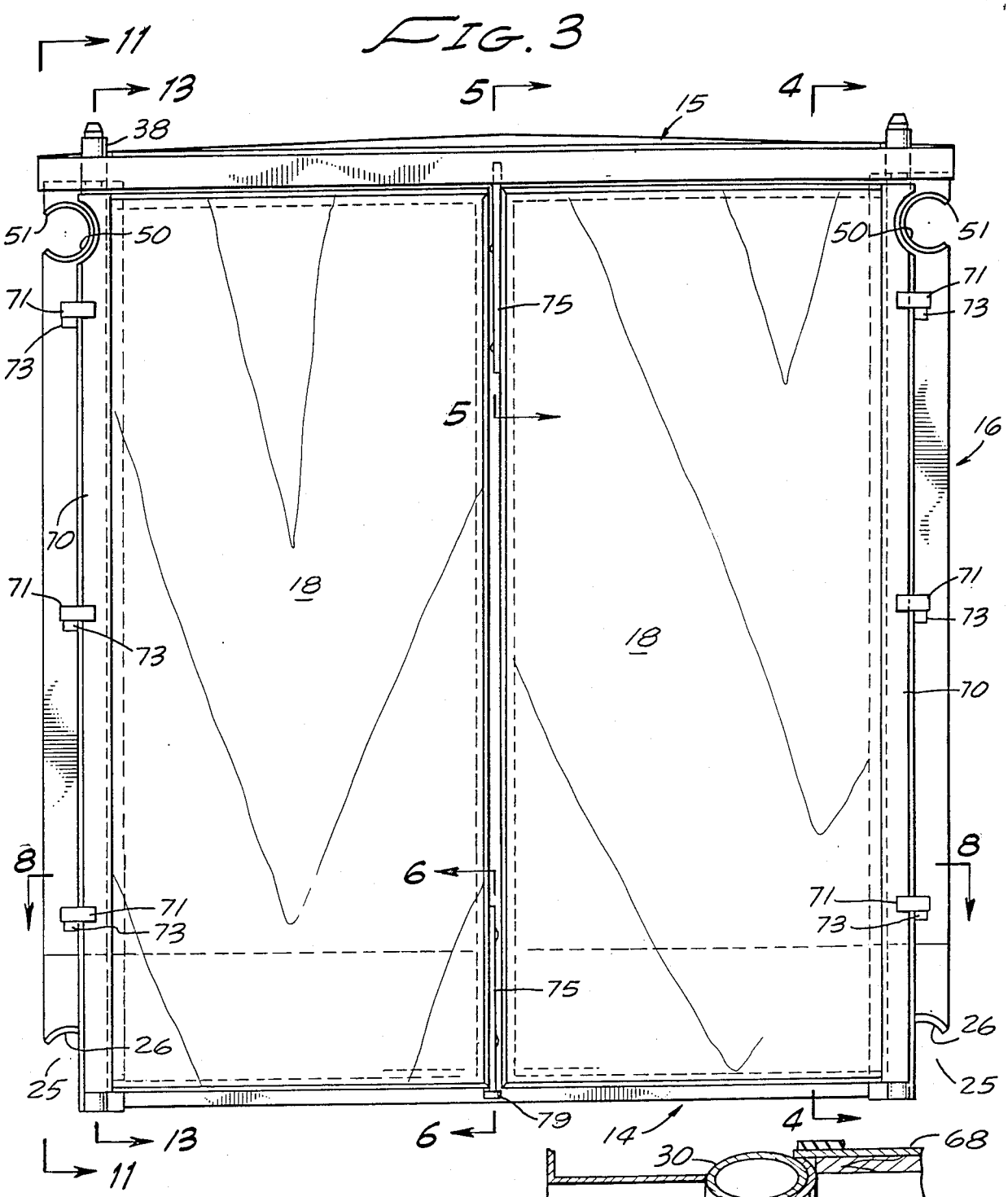
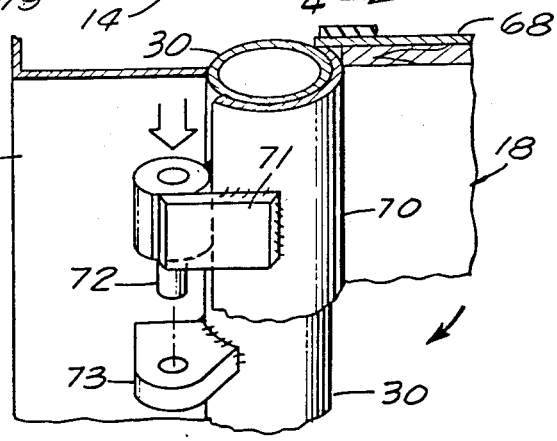
FIG. 10

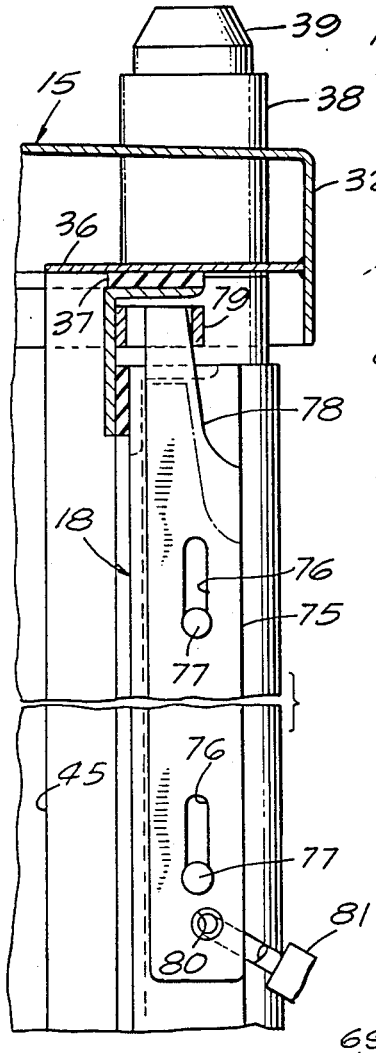
FIG. 5
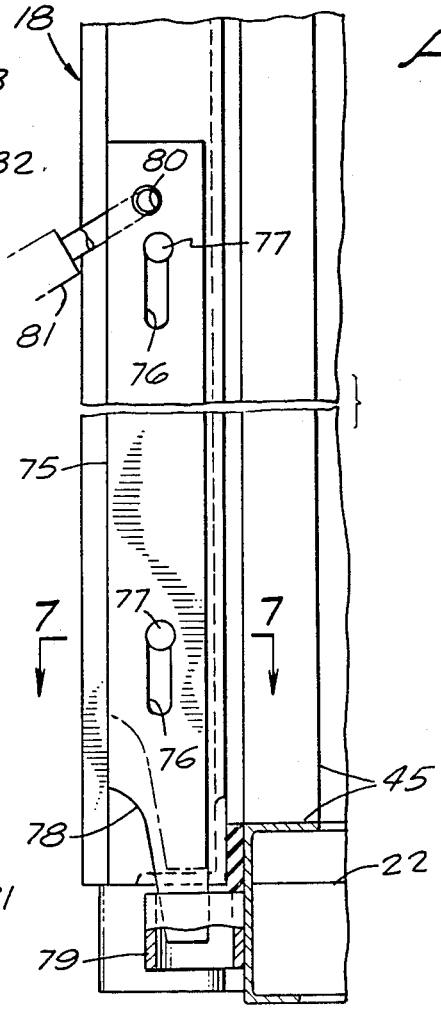
FIG. 6
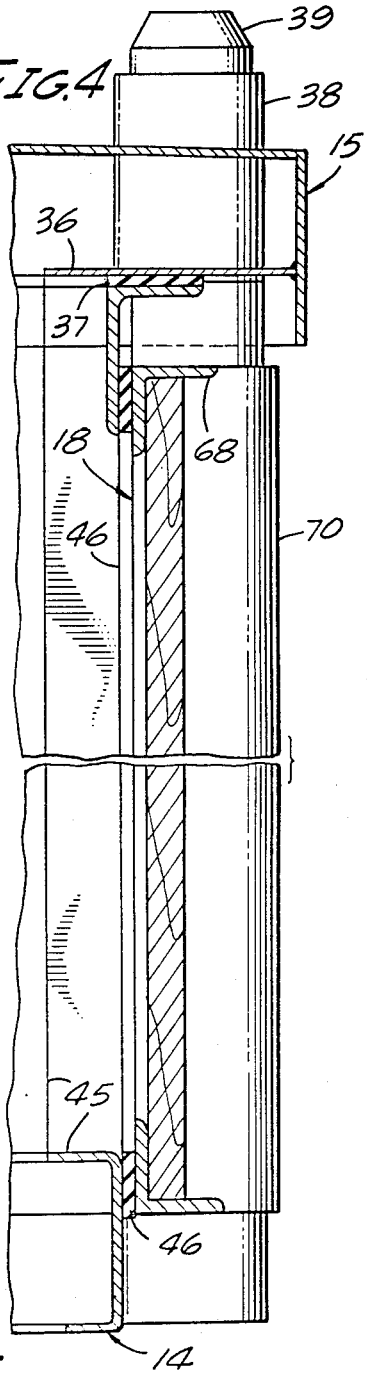
FIG. 4
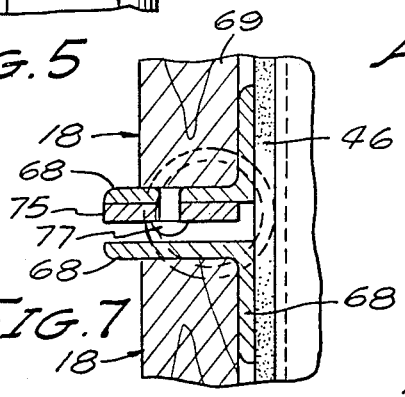
FIG. 7
FIG. 15
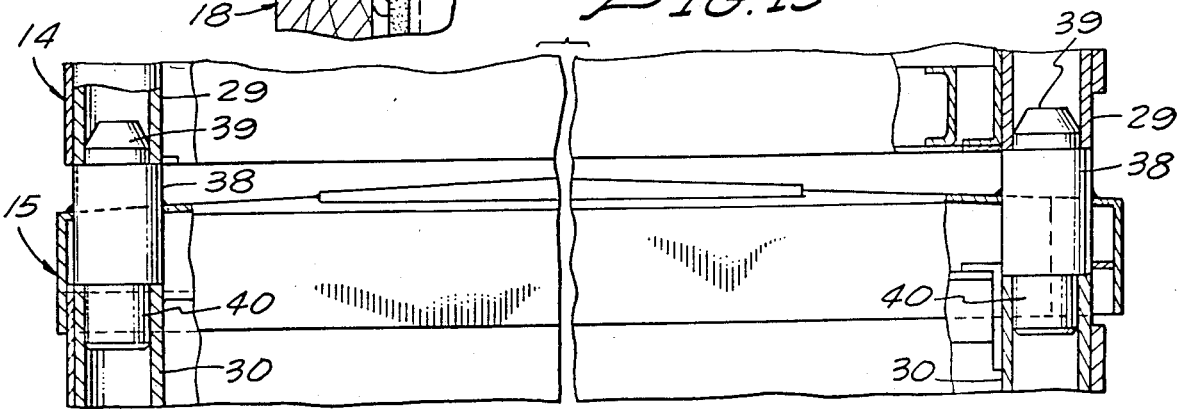

METHOD AND APPARATUS FOR SHIPPING AND STORING CARGO

This invention relates to cargo handling procedures and equipment, and more particularly to a conventional bulk container and to a unique specially designed knock down smaller container, a plurality of which are efficiently stowable in the bulk container and adapted to protect and safeguard the goods en route to separate consignees.

BACKGROUND OF THE INVENTION

Over the past century a wide variety of proposals have been made for knock down crates and containers usable to confine and protect goods and merchandise during transit. Initially such containers were designed for use in shipping a particular item in smaller bulk quantity. Many of these were reusable and returnable to the sender in knockdown condition. In recent years it has become common practice to construct cargo containers to hold quantities as large or substantially larger than railway cars and suitable for shipment by rail, ship and heavy duty truck trailers. Special equipment has been developed for transferring such containers between ship, railway car and trailer. Such containers are heavy, efficient and convenient where the contents are in transit between a single consignee and a single consignor. However, major quantities of cargo move in lots occupying only a minor portion of modern bulk cargo containers. Such shipment present serious problems involving security, handling, damage, loss by theft and costly labor problems, which problems are not avoided by shipping cargo containers heretofore proposed, representative ones of which are disclosed in the following U.S. Pat. Nos.: 525,157; 1,163,696; 2,457,842; 2,775,360; 3,040,925; 3,107,024; 3,182,846; 3,221,921; 3,306,487; 3,382,998; 3,386,605; 3,401,814; 3,760,970; 3,883,026; 3,966,285; 4,171,059; 4,422,558; 4,452,366; 4,506,789. No one of these prior constructions evidences any suggestion for a container shipping system wherein a smaller knock down tamper proof containers are specially designed for convenient and efficient stowage and shipment of the goods of individual consignees in a conventional large capacity cargo container.

SUMMARY OF THE INVENTION

In view of the foregoing shortcomings and deficiencies of prior practices for the expedited and protective shipment of bulk cargo, it is the purpose of this invention to provide a more efficient simplified and more secure equipment and mode of shipping cargo from the point of origin to multiple destination points. For this purpose there is provided a uniquely designed smaller container sized for the most efficient and effective stowage of multiple ones thereof in a conventional larger container. Preferably the smaller containers are of knock down design in which the top and the bottom provide protective covers for the remaining components if there is need for returning these empty to receive new shipments. The lightweight sidewall panels include tubular elements crosswise of their ends having interfitting telescopic engagement with portions of the top and bottom and held assembled thereto by separable fasteners. These tubular columns are designed to carry the load of the container along with its contents. The upper and lower lateral corners of the container are formed with channels extending therealong and opening outwardly and lengthwise to firmly seat a load lifting device. Such devices may consist of suspension hooks or a low height dolly insertable endwise of the lower corners and effective to lift the container clear of the floor and then along the floor. Thus, a container and its contents can be carried in suspension from its upper lateral corners or by suitable lifting means inserted into the lower corner channels.

The front end of the container is equipped with one or more doors which, when closed lie inwardly of the front edge of the top and have hinges embracing at least a major portion of one of the front corner columns. When closed these doors cannot be detached by removal of the hinge pins or otherwise, but, when open, can be readily separated at the hinge joint to provide more unobstructed access to the interior. The container components are held detachably assembled by fasteners accessible only from the interior of the container and all joints between components include gasketing to provide weather tight protection. Each container is sized to make more sufficient use of a portion of a conventional container and the portions of the container bottom between its sidewalls is designed for maximum strength and free of channels for forklift prongs or the like lifting equipment.

In view of the foregoing it is a primary object of this invention to provide an improved system, mode and apparatus for the shipment and handling of cargo.

Another object of the invention is the provision of an improved mode for utilizing large capacity cargo containers in combination with one or more smaller cargo containers for the shipment of goods of different consignees in separate tamper proof knock down containers.

Another object of the invention is the provision of a cargo container constructed for the efficient utilization of space in a larger container and capable of being loaded and unloaded thereinto by load lifting equipment insertable along the lower lateral corners thereof.

Another object of the invention is the provision of an improved knock down cargo container having provision for the use of lifting devices along either the upper or the lower lateral corners thereof.

Another object of the invention is the provision of an improved knock down container equipped with detachable tubular load transmitting columns at the four corners thereof and including provision for connecting container lifting devices to members rigidly attached either to the upper or lower ends of pairs thereof.

Another object of the invention is the provision of a knock down container sized for efficient stowage crosswise of a larger cargo container and provided with channels along the lateral corners thereof to receive load lifting dolly means.

Another object of the invention is the provision of a knock down cargo container having tubular load transmitting load columns at one end and fixed to respective side panels and wherein tamper proof doors for the container are detachably connected to said tubular columns.

Another object of the invention is the provision of a knock down cargo container wherein the top and bottom units are designed for enclosing the rear end and two side wall panels as well as two door panels when disassembled and are constructed, when assembled, to provide a weather tight shipping container.

Another object of the invention is the provision of a knock down cargo container wherein the lateral sides thereof are equipped with outwardly opening channels adapted to receive load lifting devices for the container.

There and other more specific objects will appear upon reading the following specification and claims and upon considering in connection therewith the attached drawing to which they relate.

Referring now to the drawing in which two preferred embodiments of the invention are illustrated:

FIG. 1 is perspective view of a first illustrative embodiment of the smaller cargo container forming a part of the invention shipping system;

FIG. 2 is a diagrammatic showing of the principal components of the FIG. 1 container disassembled and positioned for compact packaging;

FIG. 3 is a front end elevational view of FIG. 1 on an enlarged scale;

FIG. 4 is a cross sectional view on an enlarged scale taken along line 4—4 on FIG. 3;

Figure 8:
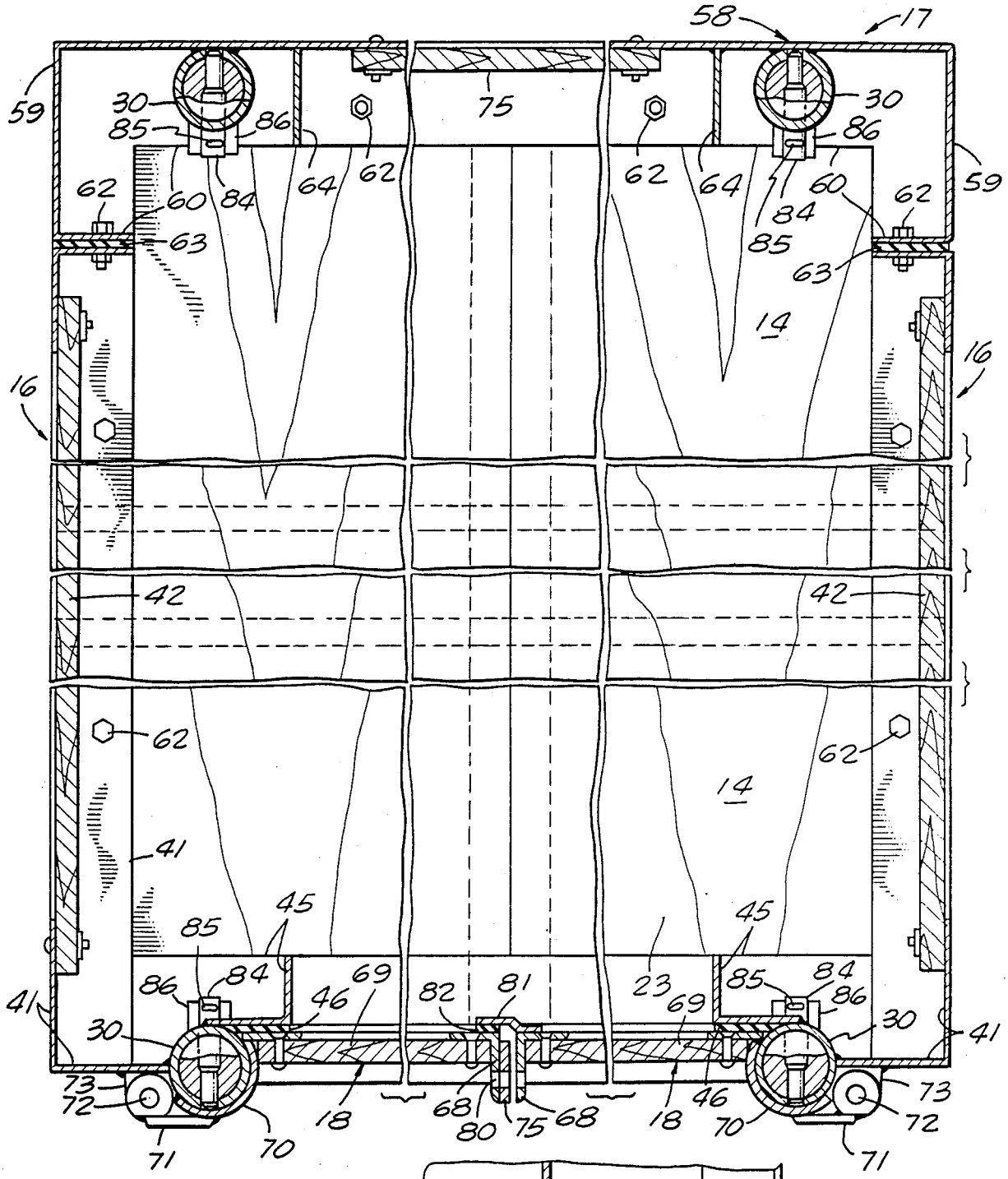
Figure 9:
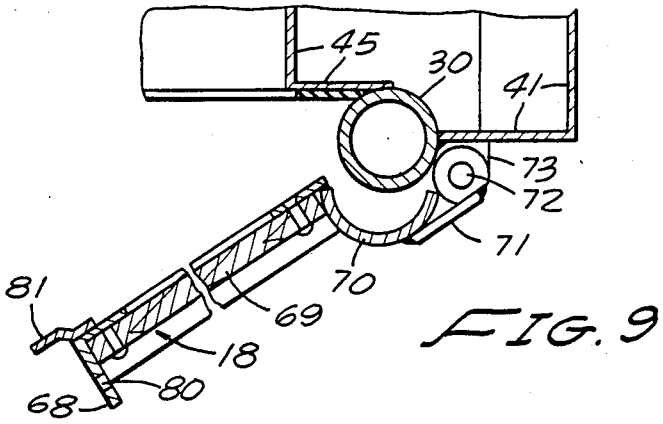
Figure 11:
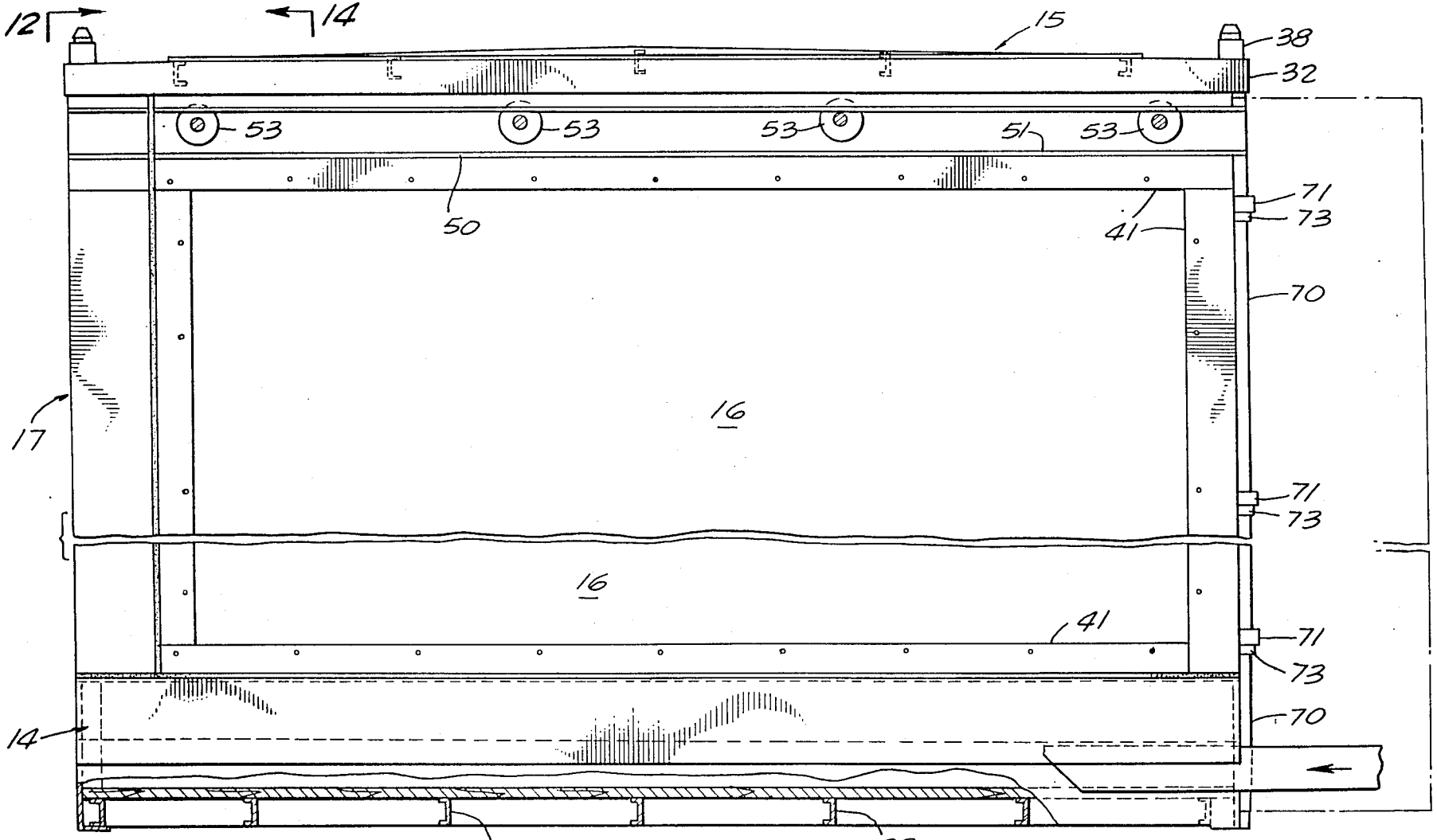
Figure 12:
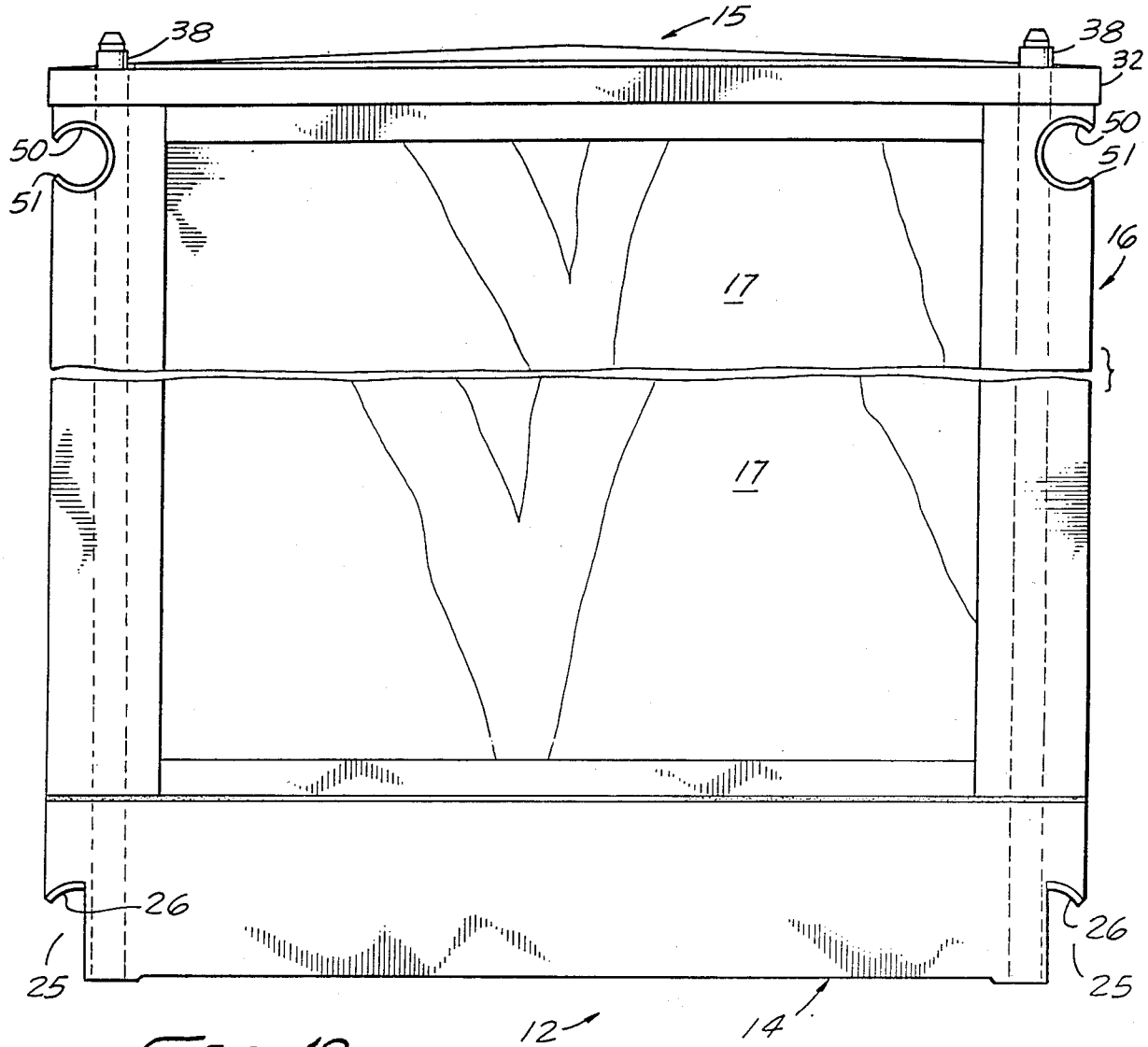
Figure 16:
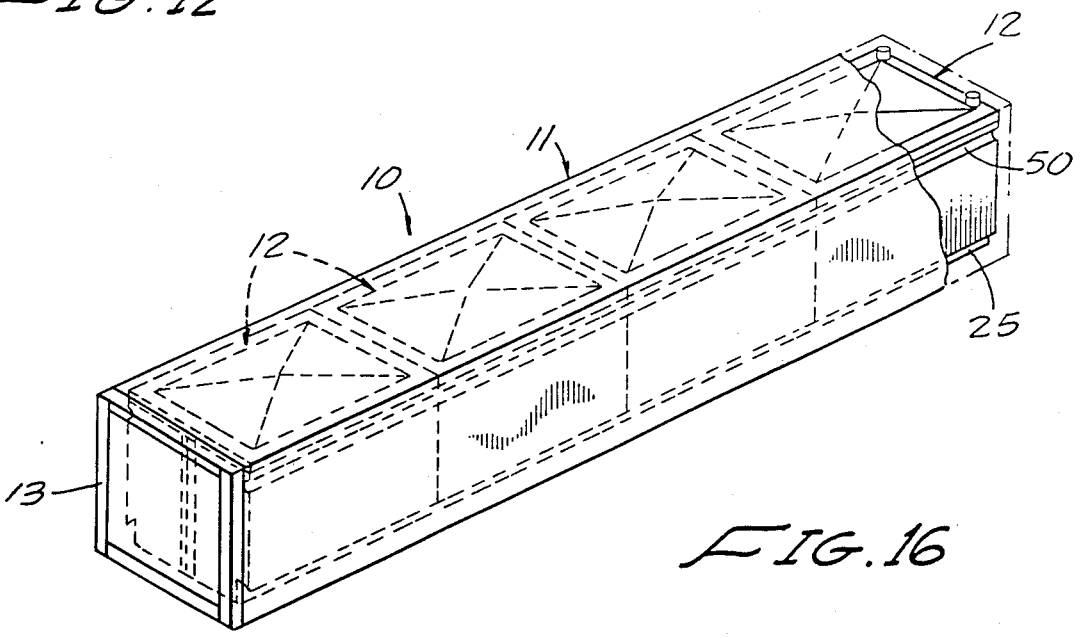
Figure 13:
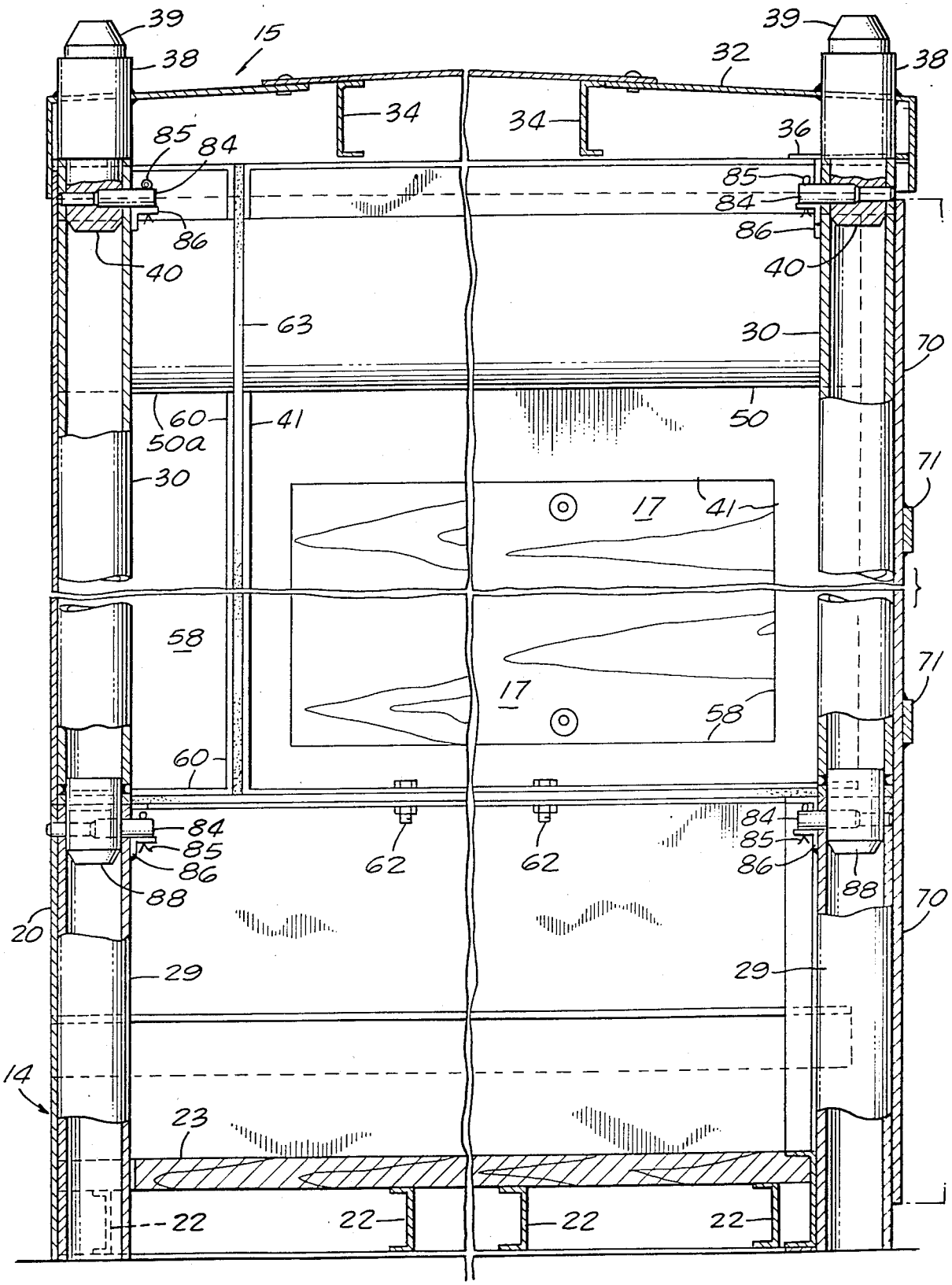
Figure 14:
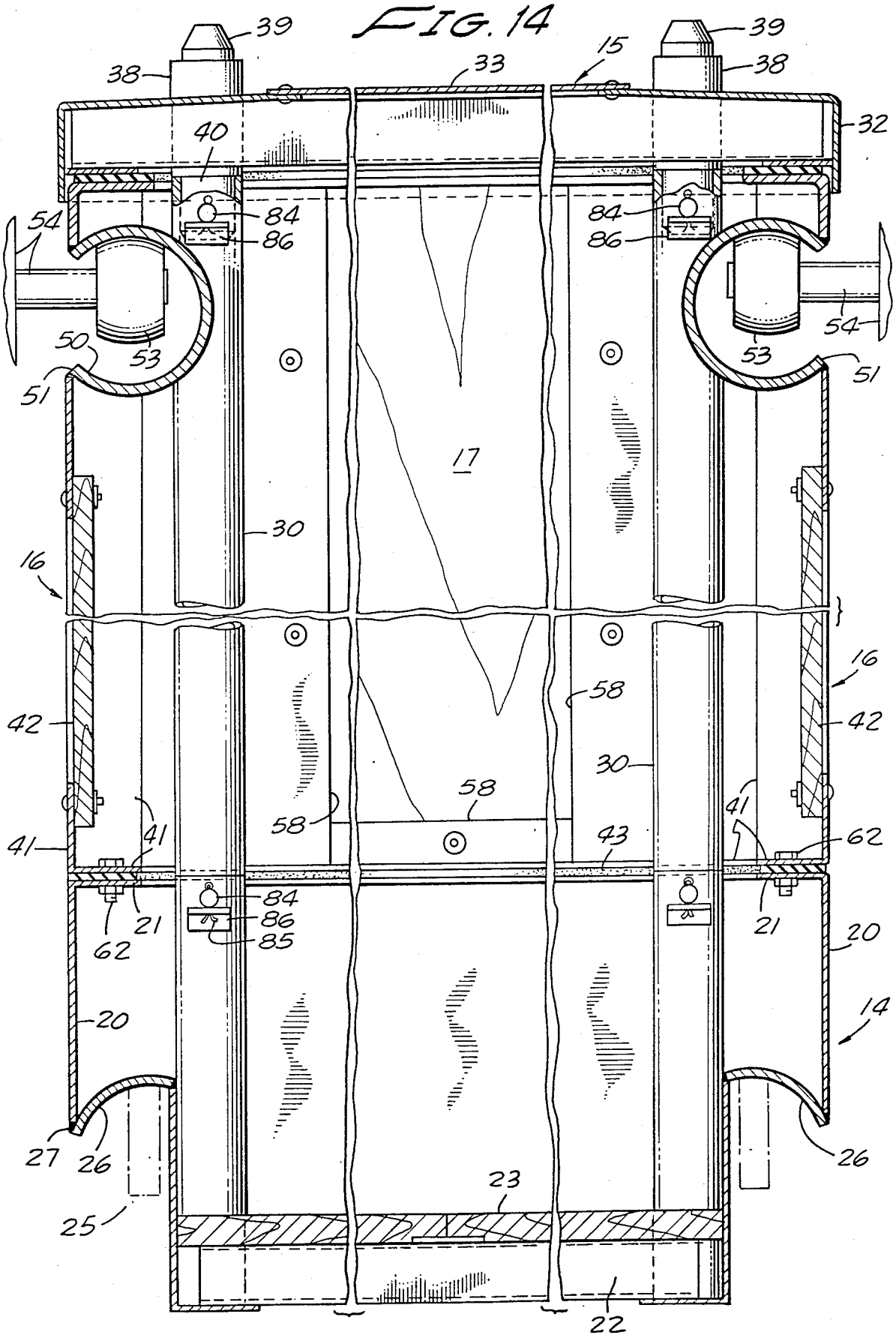
Figure 17:
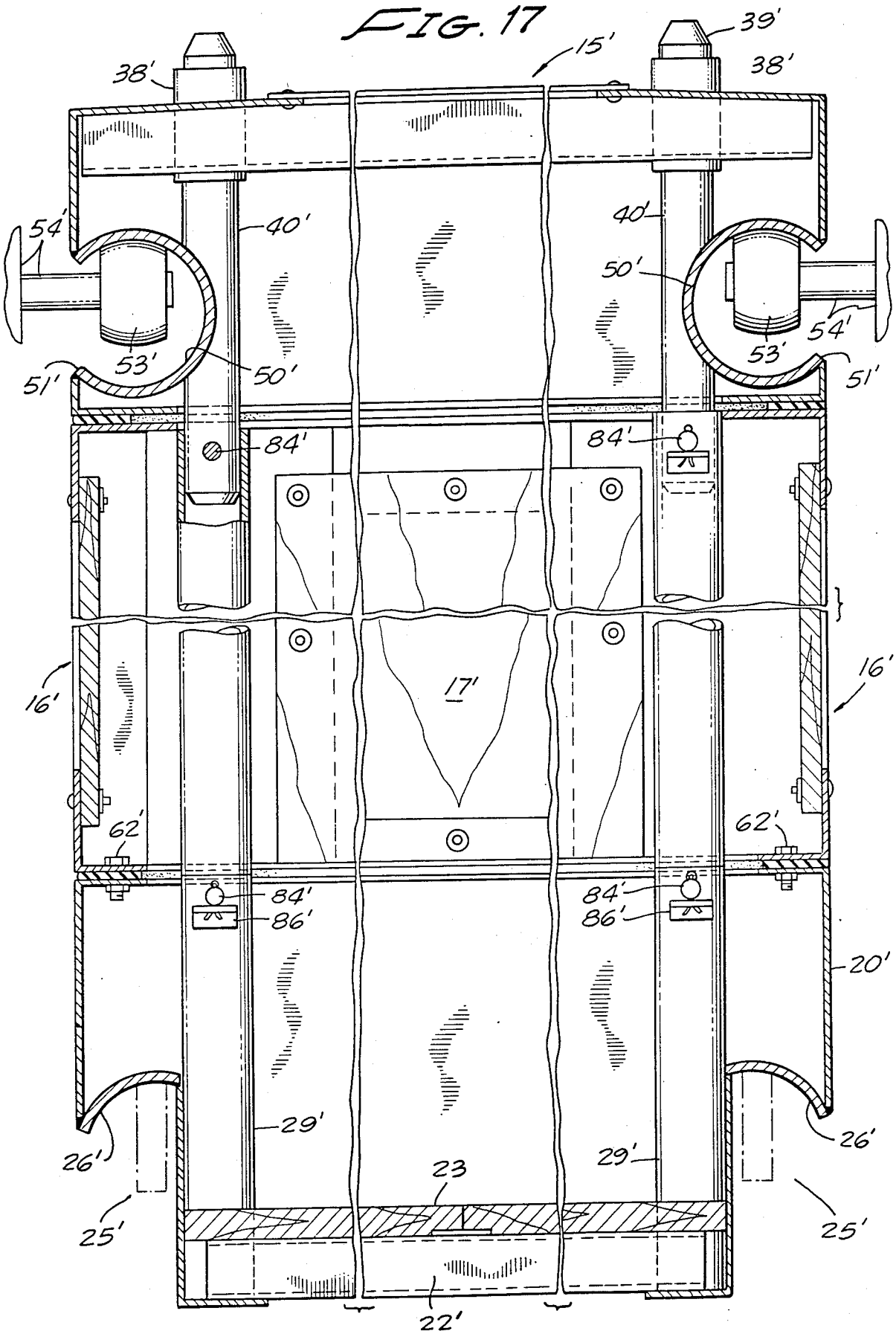

FIGS. 5 and 6 are cross sectional views on an enlarged scale taken along lines 5—5 and 6—6 on FIG. 3 showing operating details of the door locking devices;

FIG. 7 is a cross sectional view on an enlarged scale taken along line 7—7 on FIG. 6;

FIG. 8 is a cross sectional view on an enlarged scale taken along line 8—8 on FIG. 3;

FIG. 9 is a fragmentary cross sectional view of the container door and its hinge assembly with the door being shown in partially open position;

FIG. 10 is a fragmentary cross sectional view of one of the door hinges with the hinge shown in the process of being assembled;

FIG. 11 is a side elevational view of the container taken along line 11—11 on FIG. 3 and showing portions of the lower corner broken away and indicating in a general way how upper and lower load lifting devices can be utilized to handle the container;

FIG. 12 is a rear elevational view of the container taken along line 12—12 on FIG. 11;

FIG. 13 is a cross sectional view on an enlarged scale taken along line 13—13 on FIG. 3;

FIG. 14 is a cross sectional view on an enlarged scale taken along line 14—14 on FIG. 11;

FIG. 15 is a fragmentary elevational view showing two of the smaller containers in stacked position with the corner portions of each broken away;

FIG. 16 is a diagrammatic perspective view showing a plurality of the smaller containers enclosed in a larger shipping container with portions of the latter broken away to show the position of the load lifting channels for the smaller container; and FIG. 17 is a cross sectional view similar to FIG. 14 but showing a second embodiment of the smaller container wherein the upper load lifting channels are incorporated in the top rather than in the two side panels.

Referring more particularly to FIGS. 1 and 16, there is shown the container shipping system provided by this invention and generally indicated by 10 in FIG. 16. This system comprises a conventional major cargo container 11, there shown as fully occupied by four smaller demountable containers 12, 12. The large container 11 is of any well known suitable construction and typically of a size occupying a railway flat car, a large truck trailer, or of the type commonly transported by freight ships. Such containers are handled by large size gantry cranes and having an access door 13 either at one end or sometimes along areas of a sidewall. As herein shown, containers 12 are sized to make efficient and maximum utilization of a cross sectional portion of the main container with only sufficient clearance to permit insertion and removal through the access opening provided in the large container, such as the door-equipped opening 13 shown in FIG. 16.

Referring now to FIGS. 1, 2 and 8, there will be described the major components of the knock down smaller container 12. These components comprise a bottom 14, a top 15, two side panels 16, 16, a rear end panel 17 and a pair of doors 18, 18.

The structural details of bottom 14 are best shown in FIGS. 2 and 11 through 14. Except for the front end wall, the bottom is deep cup-shaped with its side walls formed of heavy gauge sheet metal 20 along its sides and across its rear end, the upper edges being turned inwardly as indicated at 21 in FIG. 14. Channel shaped stringers (FIGS. 11 and 13, extend crosswise of the bottom and are welded to the bottom side walls. Plywood decking 23 (FIG. 13), preferably bonded on its upper face to galvanized sheeting or the like, is secured to stringers 22. The opposite lateral corners of bottom 14 are provided with channels 25, 25 having downwardly and outwardly facing upper wall 26 here shown as formed of heavy gauge metal having a concave or arcuate surface disposed as shown with its opposite edges connected by welds 27 (FIG. 14) to the adjacent walls of the bottom. The recesses or channels 25, 25 are sufficiently high to accommodate a specially constructed low height dolly, not shown, having an elongated main frame supported by vertically adjustable chassis wheels adapted to be inserted endwise through the open ends of channels 25. These dollies have a length corresponding to a major portion of the length of container 12 and can be manipulated after insertion to engage surfaces 26 of the channels and lift the bottom and the container together with its content clear of a supporting floor. Once a dolly or other lifting device is engaged with the downwardly and upwardly sloping surfaces 26, the lifting device is held securely captive and against outward displacement from channels 25.

An important feature of bottom 14 is the provision of tubular sockets formed by short lengths of pipe 29, these pipes or sockets being open-ended and rigidly secured to all four corners of bottom 14 by welds all adjacent walls of the bottom including in particular the top walls 26 of recesses 25. As herein shown by way of example, top walls 26 are formed of extra heavy stock and have a downwardly facing concave surface 26 to seat a load lifting device whether of the dolly type, grapple hooks, a sling device or the like. The concave surfaces serve to center the lifting device as well as to avoid any possibility of its disengagement from the channel while in a lifting mode.

Top 15 comprises a four sided perimeter frame 32 shaped as is best shown in FIGS. 1, 13 and 14 and includes a down turned rim which overlaps and telescopes about the upper rim edges of panels 16 and 17. The center opening is closed by upwardly crowned lightweight panelling 33, formed of plywood coated with resin or other sealing material and which may include an outer metal skin bonded thereto. Welded to the interior of the down turned rim of the top is an inwardly projecting flange 36 having a layer of gasketing material 37 (FIGS. 4,5) bonded to the outer face thereof. A plurality of channel shaped stringers 34 have their opposite ends resting on and welded to flange 36 serve to reinforce and support the top panel 33. Rigidly welded to the corners of frame 32 are four posts 38 having chamfered bosses 39 and 40 projecting from their opposite ends for purposes which will become evident presently.

The sidewall panels 16, 16 along either side of the container will now be described with particular reference to FIGS. 4, 8, 11 and 14. Each side panel has an angle iron frame 41. Plywood panelling 42 is riveted or otherwise securely anchored to the flanges of frame members 41 lying in the outer plane of the panel member and the inwardly extending flanges of the frame are provided with holes to receive fastener bolts. Gasketing material 43 is secured to the outer surfaces of these flanges to render the same water tight when bolted to other adjacent components. Panels 42 are formed of suitable lightweight high strength material such as plywood coated with resin and may include sheet metal outer surfaces for greater protection against abrasion and damage.

Welded to the upright forward ends of panels 16 are respective tubular members 29 and additional angle iron members 45. Tubular members 29 are welded to the edges of a respective flange of each of the angle irons 41, 45, in a manner best shown in FIGS. 8 and 9. As there shown, the flange of frame members 41 projecting toward one another, lie in a generally common bisector plane through the two tubular members whereas the transversely extending flange of angle iron members 45 are welded to the innermost wall of members 29 at a point generally 90 degrees from the point of attachment of flanges of frame members 41. These flanges of members 45 lie in a common plane forming the jam for door panels 18 when the latter are in closed position. Bonded to the outer surfaces of the door jamb is a layer of suitable gasketing material 46.

An important structural feature of side panels 16, 16 is best illustrated in FIGS. 11, 13 and 14 and comprises high strength, load lifting channel members 50, 50, having a wide slot 51 opening outwardly through their outer wall and rigidly welded to frame members 41 and to the tubular members 30 in cutouts shaped to seat the adjacent inner wall portions of members 50 as is made clear by FIG. 14. As herein shown by way of example, channel members 50 are formed of thick walled tubing, having a portion of the outer sidewall cut away sufficiently to receive grappling hooks or the rollers 53 of a load lifting device indicated at 54 (FIG. 14). Such devices may be inserted laterally through slots 51 or from either open end of channel members 50.

The rear end panel 17 will now be described and is best shown in FIGS. 1 and 8. This panel has a heavy gauge metal frame 58 which embraces the entire rear end of the container by reason of narrow legs 59 (FIG. 8) which extend around each rear corner and terminate in inwardly extending flanges 60. Flanges 60 extend inwardly from all four edges of frame 58 and are provided with holes to receive bolts 62 several of which are shown in FIG. 8. These bolts pass through similar flanges extending inwardly from bottom 14, top 15 and each of the side panels 16. Gasketing material 63 is clamped between the flanges and is preferably bonded to one of the flanges. Also welded to frame members 58 are inwardly extending flanges 64 which terminate at the upper and lower inwardly extending flanges 60 and are welded thereto. The two rear tubular members 30 are also rigidly welded to frame members 58 and open through the upper and lower flanges 60 of the frame member to which they are welded. The large center opening defined by frame 58 is closed by a panel 75 formed of lightweight plywood material coated with resin and preferably bonded to a metal skin. This panel is riveted or otherwise securely mounted against the inner face of frame 58 as is made clear by FIG. 8. As is best shown in FIGS. 1 and 13, each upper corner of the rear panel frame 58 has a short length of the slotted tubular channel member 50' welded to it in alignment and registry with the adjacent end of channel member 50 in the side panels 16. Channel 50' is of the same size as the main channel 50 and is welded to the adjacent one of the tubular members 30 and to all contiguous portions of the rear panel frame 58.

The door assemblies 18 closing the front end of the container will now be described by reference to FIGS. 1 and 5 through 9. Each of the door panels has an angle iron frame to which a plywood panel 69 is rigidly secured as by rivets. When closed, the doors 18 lie in a plane inwardly of the front edge of the container top with the inner surface generally tangent to the inner sides of the two corner tubular members 30, 30. Each door is provided with a semitubular hinge leaf having a close embracing fit about a major portion of the outer surface of one of the tubular members 30. Each hinge leaf 70 closely embraces approximately one half of the exterior of members 30 and includes a plurality of brackets 71 welded thereto and provided with integral hinge pins 72 the lower exposed ends of which are detachably socketed in a hinge leaf bracket 73 (FIG. 9) welded to the exterior of tubes 30 and to the adjacent area of frames 41 of side panels 16, 16.

As is made clear by FIG. 8, when the doors are closed, the innermost ends of the arcuate hinge leaves 70 are positioned well inwardly of a vertical plane through the centers of tubular members 30, 30. For this reason, the door panels cannot be detached by removing or drilling away the hinge pins 72. However, when the doors are opened outwardly to a position such as that shown in FIG. 9, either door can be lifted vertically until the hinge pins 72 are separated from the stationary hinge leaves 73.

Simple means for locking each of the door panels snugly closed with the gaskets surrounding each of the perimeters compressed snugly against the door jamb are shown in FIGS. 5–7. The outwardly extending flanges of the angle iron door frames 68 are spaced sufficiently apart to accommodate a pair of slide bars 75, each having a pair of slots 76 along the midlength held slidably captive to the frame member by shouldered rivets 77. FIG. 5 shows one of the slide bars 75 mounted along the upper corner of the door frame and FIG. 6 shows a similar slide bar mounted along the lower corner of the door. The remote ends of these bars are cut away along an inclined surface indicated at 78 and have a camming and locking engagement with tubular detents 79 welded to the frames of the container bottom 14 and top 15 respectively. Bars 75 and the door frame member 68 are provided with openings 80 which are in alignment when the slide members are extended to their locking position, at which time a padlock 81 can be assembled through holes 80 to lock the bars in locking position. A bridging strip 81 (FIG. 8) is welded along the inner face of one door frame to overlap the gap between the edges of the two doors and is designed to compress a strip of gasket material 82 bonded to the inner face of the other door edge to provide a weather tight joint when the doors are closed.

In addition to bolts 62 interconnecting the flanges of the principal panels to one another, there is provided means for locking the opposite ends of tubular members 30 at the corners of the container to bottom 14 and top 15. These comprise pins 84 best shown in FIG. 13. Thus the chamfered lower ends 40 of the posts 38 welded to the corners of top 15 are sized to have a snug telescopic fit within the upper ends of the four corner tubes 30. Both the posts and tubes 30 are provided with transverse bores to receive shouldered locking pins 84 inserted from the interior of the container and provided with cotter pins 85 or the like extending through pins 84 and into aligned holes in a bracket 86 secured to the side of tube 30. Likewise, posts 88 are welded to and project beyond the lower ends of members 30. Posts 88 and the tubular sockets 29 in the container bottom are provided with aligned holes to receive locking pins 84 identical with similar pins just described thereby locking pins 84 in assembled position. Both the smaller end and the shoulder of pins 84 are tapered or chamfered to facilitate insertion of the pins which, when installed have a close fit with the holes in tubes 24, 30 and posts 40 and 88. As will be evident, pins 84 in cooperation with the tubular members 30, serve to transmit the major portion of the weight of the container and its contents when channels 50 are used to lift the container.

SECOND PREFERRED EMBODIMENT

Referring to FIG. 17, there is shown a second preferred embodiment of the smaller container wherein the same or similar components are designated by the same reference character as in FIGS. 1 through 16, but are distinguished therefrom by the addition of a prime. The second embodiment differs from the first embodiment essentially in that the container top 15′ is deeper and modified to incorporate the two channels 50′ having the longitudinally extending slot 51′ opening through its outer lateral side wall portion of top frame 32′. The posts 38′ at the four corners of the top are substantially longer than in the first embodiment and have a portion of the outwardly facing sidewall of each notched to seat one of the channel members 50′. These posts are welded to the juxtaposed surfaces of the channel members as well as to all contiguous portions of the top frame. From the foregoing it will be evident that the upper channel members 50′ are formed in one piece along the full length of each lateral side of the container top and are an integral part of the top rather than a part of the side wall and rear end wall panels as in the first embodiment.

FIG. 2 shows the principal parts of the container of the first embodiment disassembled and positioned for snug packaging in collapsed condition. The components are stacked as there shown and then strapped or otherwise suitably secured together in a compact bundle for transport to a place of reuse. The components of the second embodiment shown in FIG. 17 are adapted to be similarly packaged when not in use.

When readying one of the smaller containers for use, the operator removes the strapping and unstacks the components. One sidewall panel is then uprighted along one side of bottom 14 following which the rear panel and the other side panel are similarly uprighted and positioned along the rear and other side edge of the bottom. In each instance the posts 88 at the lower ends of these panels are inserted in sockets 29 at the corners of the bottom and several bolts 62 are inserted across the adjacent flanges of the respective panels to hold them in an upright position. The top 15 is then lifted into position and its posts 40 are lowered into the upper ends of the tubular members 30 of the three panels. The operator then proceeds to assemble each of the fastener bolts 62 and to tighten all snugly. Either before or after completing this operation the several locking pins 84 are inserted from the interior of the container and secure to them against disassembly by the insertion of the cotter pins 85. The final operation is to assemble each of the door panels 18 by supporting each in an open upright position and lowering their hinge pins 72 into the holes in the stationary hinge brackets 73.

The container is now in readiness to receive cargo and to have its doors locked closed by the extension of the two locking bars 75, into their respective sockets 79 to cam them snugly closed against their gaskets after which the padlocks are inserted and snapped closed as shown in FIGS. 5 and 6. When the doors are closed the seals along all edges of the doors are held compressed by camming action of the locking bars 75 on sockets 79 and the entire container and its contents are weather tight and may be stored and shipped without risk of moisture reaching the cargo.

The loaded containers 12 and 12′ are readily moved using conventional sling and grapple equipment having hooks engageable in channels 25 extending along the lower corners of the containers or within channels 50 extending along the upper lateral corners. During other than short hauls containers 12 will be loaded into bulk cargo containers 10 shown in FIG. 16 through its access doors 13. Movement of containers 12 into and out of these bulk containers is best accomplished using a specially constructed dolly, not shown, insertable through the open ends of channels 25. Such dollies are inserted while the chassis frame is in a lowered position out of contact with top surface 26 of channels 25. Once the dollies are in position, the chassis frame is securely elevated in engagement with the surfaces 26 whereupon the dolly is employed to move container 12 into or out of the main container 10.

While the particular method and apparatus for shipping and storing cargo herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. That method of shipping and safeguarding cargo which comprises:

providing a first relatively large reusable cargo container of the type conventionally employed to ship cargo by ship, flat car and/or flat bed truck; and providing a plurality of reusable second knock down cargo containers sized for efficient stowage of a plurality thereof within said first mentioned container each provided with lock equipped access doors whereby the cargo of different consignees can be stored in said separate knockdown containers and shipped together in a common container and later distributed individually while retained locked in said separate knock down containers.

2. That method defined in claim 1 characterized in the step of utilizing reusable knock down second containers at least one of which is sized to make efficient utilization of substantially the entire cross section of an interior portion of said first cargo container.

3. That method defined in claim 1 characterized in the step of providing each of said second cargo containers with channels adjacent and lengthwise of the lower lateral corners thereof to receive roller equipped lifting means useful in moving said second cargo containers into and out of said first cargo container.

4. That method defined in claim 3 characterized in providing said load lifting channels along each of said lower lateral corners of said second cargo containers with downwardly facing recesses operable to retain load lifting means captively seated therein while in load supporting engagement therewith.

5. That method defined in claim 1 characterized in the steps of utilizing said second cargo containers of separate consignors in safekeeping during loading thereof into said first cargo container; transporting said first cargo container loaded with a plurality of said second containers to a distant distribution site; and thereafter transferring each one of said second containers to the respective consignees of the cargo therein while said access doors thereof remain locked.

6. That method defined in claim 1 characterized in the step of providing said second cargo containers with a slotted channel opening outwardly along the upper lateral corners of said second cargo containers operable to seat lifting means to lift and transfer individual ones of said second cargo containers and the contents thereof from one location to another.

7. That method defined in claim 6 characterized in the step of providing said slotted channels with open ends adapted to receive roller equipped lifting means including means extending outwardly through the slot of said slotted channels.

8. An improved cargo container system comprising in combination:

a relatively large reusable first cargo container adapted for use in the shipment of locked up bulk cargo by ship, railway flat car or motor truck;

a reusable second cargo container sized for the loading of a predetermined number thereof into said first container; and said second container having a height approaching but less than the interior height of said first cargo container and each having lockable access door means for safeguarding the contents of said second cargo container while locked.

9. A cargo container system as defined in claim 8 characterized in that said second cargo container includes sidewall panels, access door means, a bottom and a top held detachably assembled by readily disassembled fastener means; side sidewall panels, said access door means and said fastener means being adapted to be compactly packaged between said top and said bottom after disassembly of said second cargo container; and a plurality of said compactly packaged second container components being stowable in said first container.

10. A cargo container system as defined in claim 8 characterized in that said second cargo container bottom is provided along the opposite corner edges thereof with a respective open ended channel each adapted to receive a load lifting device for use in transferring said second cargo container into and out of said first cargo container.

11. A cargo container system as defined in claim 8 characterized in that said top of said cargo container includes an open ended channel along the opposite edges thereof each provided with an outwardly opening slot therealong adapted to receive and accommodate load lifting means for said second cargo container when not housed within said first cargo container.

12. A cargo container system as defined in claim 11 characterized in the provision of a separate upright tubular member having the upper end thereof detachably connected to a respective end of said open ended channel, and means detachably connecting the lower ends of said tubular members to a respective adjacent corner of said container bottom.

13. A cargo container system as defined in claim 8 characterized in that said second cargo container comprises a rigid unitary bottom, a rigid unitary top, a pair of unitary side panels each having rigid tubular means fixed to and extending along the opposite ends thereof; an end panel interconnecting said side panels between one set of adjacent ends thereof; means rigidly secured to the corners of said unitary bottom and said unitary top for telescopic assembly to the opposite ends of said tubular means; and fastener means for holding said unitary top and said unitary bottom detachably and rigidly assembled.

14. A cargo container system as defined in claim 13 characterized in the provision of access door means pivotally attached to at least one of said tubular means remote from said end panel by hinge means separable by upward bodily movement of said access door means relative to said tubular means; and a substantial portion of said access door means, when closed, lying inwardly of and closely spaced from the overlying peripheral edge portion of said top thereby to thwart disassembly of said hinge means and of said access door means from said second cargo container while said access door means remains closed.

15. A reusable knock down cargo container comprising:

a four sided top and a four sided bottom separably interconnected by a pair of side panels and a transverse rear end panel having front and rear pairs of load bearing and load transmitting tubes fixed to and extending along the front and rear corners of said container panels and including means for separably interconnecting the ends of said tubes to a respective adjacent corner of said top and said bottom; and door means detachably and pivotally supported by at least one of said load bearing tubes at the front end of said container.

16. A reusable cargo container as defined in claim 15 characterized in the provision of a lifting channel extending along and opening outwardly through the opposite sides thereof for the reception of lifting means for said container and cargo storable therewithin.

17. A reusable cargo container as defined in claim 16 characterized in that said lifting channels having a downwardly facing surface shaped to retain a load lifting device against outward movement so long as in lifting contact therewith.

18. A reusable cargo container as defined in claim 15 characterized in that said lifting channels are open at the opposite ends thereof for the reception of a load lifting device.

19. A reusable cargo container as defined in claim 15 characterized in that said lifting channels are tubular in cross section and provided with a slot along the outwardly facing lateral side thereof.

20. A reusable cargo container as defined in claim 15 characterized in that said lifting channels are located along the lower lateral corners of said container bottom and open downwardly and outwardly and are adapted to receive a wheel equipped lifting dolly lengthwise of said lifting channels.

21. A reusable cargo container as defined in claim 20 characterized in that said lifting channels have a downwardly and outwardly inclined surface engageable with a load lifting device.

22. A reusable cargo container as defined in claim 15 characterized in the provision of a pair of outwardly opening container lifting channels along the upper and lower corner portions of the lateral sides thereof each adapted to receive a lifting device.

23. A reusable cargo container as defined in claim 22 characterized in that said lifting channels along said lower corners have upper surfaces which are inclined downwardly and outwardly and which open through the lower lateral corner portion of said container.

24. A reusable cargo container comprising a four sided box including as components, a pair of sidewall panels, a rear panel, a top, a bottom, pivoting door panel means for the front end thereof, and upright tubular means at the four corners thereof including means for detachably interconnecting said components together;

the opposite lateral sides of said bottom each having an open ended downwardly and outwardly opening channels adapted to accommodate a load lifting device.

25. A cargo container as defined in claim 24 characterized in that said rear panel includes as an integral part thereof one pair of tubular means located one along either vertical edge thereof; and said other pair of tubular means being integral with and located along the forward vertical edge of a respective one of said sidewall panels.

26. A cargo container as defined in claim 24 characterized in the provision of a container having an open ended channel extending along either upper lateral corner thereof each of which channels has an arcuate upper wall adapted to seat and automatically center transversely crowned roller means of a load lifting device; and said open ended channels being slotted along the outwardly facing side thereof.

27. A cargo container as defined in claim 24 characterized in that said pair of tubular means at the front end thereof includes a pair of circular tubes; said door panel means including a pair of panels provided with rigid hinge leaves embracing a major portion of said circular tubes and pivotally supported adjacent the side thereof remote from said door panels when in closed position in a plane generally inwardly of a plane through the axes of said pair of circular tubes and underlying the front transverse end of said container top.

28. A cargo container as defined in claim 27 characterized in that said door hinge leaves each include a hinge pin telescopically matable with a hole in a cooperating hinge member fixed to a respective adjacent one of said circular tubes; and said door panels and said hinge leaves being detachable when pivoted to an open position by lifting the same until said hinge pins are free of the hole in said cooperating hinge member.

29. A cargo container as defined in claim 28 characterized in that the front transverse edge of said roof closely overlies the upper edges of said door panels when closed and cooperating therewith to prevent the separation of said hinges so long as said doors are closed.

30. A cargo container comprising a four sided box having a top and a bottom and an opening across one end thereof; a pair of circular tubes extending along the opposite sides of said opening, a pair of doors for said opening hingedly supported for pivotal movement between a closed position generally inwardly of a plane common to the axes of said tubes and including pairs of hinge leaves one portion of which embraces a major exterior portion an adjacent one of said tubes and is fixed to said door panel and the other portion of which is fixed to said container on the opposite side of said tubes, said pairs of hinge leaves being separably interconnected by a hinge pin fixed to one of said hinge leaves; and means for locking said door panels closed.

31. A cargo container as defined in claim 30 characterized in that the front edge of said top overlies the top edge of said pair of doors sufficiently close as to prevent the elevation of said doors sufficiently to separate said hinge pin from the other one of said hinge leaves and permit the detachment of said doors from container box.

32. A cargo container as defined in claim 31 characterized in that said doors are independently detachable from said box when in open position by elevating the same until the associated hinge pins are disengaged from the associated ones of said hinge leaves.

33. A cargo container as defined in claim 30 characterized in the provision of means for locking said doors closed including means having limited vertical movement on the lateral edge of one of said doors and having a tapered end extendable across one end edge of said door and movable across a detent mounted on the front end of said container when said door is closed and thereby operable to cam and hold said door snugly closed.

34. A cargo container as defined in claim 33 characterized in that said container is equipped with similar locking means operatively mounted for locking movement across both the upper and lower edges of said door and including separate means for utilizing padlock means to lock each one thereof in door locking position.

35. A knock down cargo container comprising:

a bottom having sidewalls, a rear wall and an open front end;

a top;

a pair of sidewall panels and a rear end wall panel detachably securable between said bottom and said top; and said bottom having a channel extending along either lateral corner thereof adapted to receive and seat a lifting device for said container.

36. A cargo container as defined in claim 35 characterized in that said channels have an upper sidewall the lower surface of which faces downwardly and inwardly and is adapted to retain captive a load lifting device in contact therewith.

37. A cargo container as defined in claim 35 characterized in that the opposite ends of said channels are unobstructed and receptive of a load lifting device insertable lengthwise of said channels.

38. A cargo container as defined in claim 35 characterized in that the upper sidewall of said channels is generally concave.

39. A cargo container as defined in claim 35 characterized in that the opposite lateral sides of said top are provided with channel means extending therealong and opening outwardly, said channels being constructed to receive and seat load lifting means for lifting said container and its cargo contents.

40. A cargo container as defined in claim 39 characterized in the provision of load transmitting members rigidly connecting said channel means in said top and said bottom.

41. A cargo container as defined in claim 39 characterized in that said channel means along the sides of top comprising tubing having open ends and a slot extending along the outwardly facing side thereof.

42. A four sided knock down cargo container comprising:

a bottom;

a top;

four tubular members detachably interconnecting said top and said bottom between the corners of said top and bottom and including a pair of side panels and a rear panel detachably securable between the rims of said top and said bottom;

a pair of door panels for closing the front end of said container and adapted when closed to lie in a plane inwardly of the front end of said top; and hinge means pivotally connecting the remote lateral edges of said door to the outer lateral sides of a respective one of said tubular members at the front end of said container.

43. A cargo container as defined in claim 42 characterized in that said hinge means is so constructed that said door panels are readily detachable from said tubular members when pivoted outwardly beyond the front end of said top but are not detachable while in closed position inwardly of a vertical plane through the front end of said top.

44. A cargo container as defined in claim 43 characterized in that said hinge means includes a plurality of hinge leaves secured to said door panels and shaped to embrace a major outwardly facing portion of an adjacent one of said tubular members when said door panels are closed.

45. A cargo container as defined in claim 42 characterized in the provision of gasket means positioned to provide a substantially weather tight seal between said door panels and the contiguous surfaces of the front end of said container when said door panels are closed.

* * * * *